United States Patent [19]

Jogand

[11] 4,305,458

[45] Dec. 15, 1981

[54] REACTORS IN WHICH THE COOLING OF THE CORE IS BROUGHT ABOUT BY THE CONTINUOUS CIRCULATION OF A LIQUID METAL

[76] Inventor: Patrick Jogand, Les 3 Moulins - Bat. A, 13100 Aix en Provence, France

[21] Appl. No.: 49,487

[22] Filed: Jun. 15, 1979

[30] Foreign Application Priority Data

Jun. 22, 1978 [FR] France ..... 78 18711

[51] Int. Cl.[3] ..... F28F 9/00

[52] U.S. Cl. ..... 165/162

[58] Field of Search ..... 165/162, 161, 160, 159, 165/172

[56] References Cited

U.S. PATENT DOCUMENTS

| | | | |
|---|---|---|---|
| 2,505,695 | 4/1950 | Villiger et al. | 165/162 |
| 3,292,691 | 12/1966 | Welter et al. | 165/172 X |
| 3,566,961 | 3/1971 | Lorenz et al. | 165/160 X |
| 3,916,990 | 11/1975 | Ruhe et al. | 165/162 X |
| 3,973,624 | 8/1976 | Bratthäll et al. | 165/161 X |

*Primary Examiner*—Sheldon J. Richter

*Attorney, Agent, or Firm*—Michael N. Meller

[57] ABSTRACT

Intermediate exchanger comprising a vertically axed cylindrical internal ferrule, an external ferrule coaxial to the internal ferrule, two plates with annular horizontal tubes located in the vicinity of the upper and lower ends of said ferrules, a bundle of straight tubes extending between the tubed plates in the form of cylindrical layers coaxial to the ferrules, said layers being mutually reinforced by transverse belts formed by horizontal bands carrying hollow members located between the tubes of the layers and in contact with the latter, collectors for the admission and discharge of the secondary fluid circulating within the said tubes being respectively provided beneath the lower plate and above the upper plate, the inner ferrule forming a pipe for the supply of the secondary fluid to the admission collector, while the outer ferrule is upwardly extended by a pipe for the discharge of the same secondary fluid collected in the discharge collector after passing through the tubes, and inlet and outlet ports distributing about the axis of the outer ferrule for the admission and discharge, in the vicinity of the tubed plates, of a primary fluid which exchanges calories with the secondary fluid through the wall of the tubes, wherein the bundle of tubes has means able to bring about a larger supply in the area occupied by the tubes of the inner layers than in the area occupied by the tubes of the outer layers, said means creating, in the circulation of primary fluid within the exchanger, a variable pressure drop.

3 Claims, 6 Drawing Figures

REACTORS IN WHICH THE COOLING OF THE CORE IS BROUGHT ABOUT BY THE CONTINUOUS CIRCULATION OF A LIQUID METAL

BACKGROUND OF THE INVENTION

The present invention relates to reactors in which the cooling of the core is brought about by the continuous circulation of a liquid metal, namely sodium, contained within a main vessel in which is immersed the core, the calories acquired by the liquid metal on passing through the latter on contact with the fuel assemblies being transferred to a secondary fluid, which is also sodium, which internally passing through the tubes of an intermediate exchanger which pass into the vessel, the liquid cooling metal of the core acting as the primary fluid circulating externally of said tubes in thermal exchange relationship with the secondary fluid. In known manner, the secondary fluid which is in this way heated is then returned externally of the reactor vessel to a generator able to supply pressurized steam directly expanded in an electricity generation plant.

The present invention more specifically relates to an arrangement of the internal structure of such an intermediate exchanger comprising in per se known manner a vertically axed cylindrical internal ferrule, an external ferrule coaxial to the internal ferrule, two plates with annular horizontal tubes located in the vicinity of the upper and lower ends of said ferrules, a bundle of straight tubes extending between the tubed plates in the form of cylindrical layers coaxial to the ferrules, said layers being mutually reinforced by transverse belts formed by horizontal bands carrying spacing members located between the tubes of the layers and in contact with the latter, collectors for theadmission and discharge of the secondary fluid circulating within said tubes being respectively provided beneath the lower plate and above the upper plate, the inner ferrule forming a pipe for the supply of the secondary fluid to the admission collector, whilst the other ferrule is upwardly extended by a pipe for the discharge of the same secondary fluid collected in the discharge collector after passing through the tubes, and inlet and outlet ports distributed about the axis of the outer ferrule for the admission and discharge, in the vicinity of the tubed plates, of a primary fluid which exchanges calories with the secondary fluid through the wall of the tubes.

In a conventional construction of this type, the primary fluid therefore penetrates in a transverse manner the exchanger by the inlet windows, being distributed in the space between the inner and outer ferrules in order to circulate after a first change of direction of essentially 90° in contact with the tubes in the bundle, the flow taking place over most of the length of said tubes in countercurrent to the secondary fluid, the primary fluid undergoing a second change of direction of once again 90° and is then discharged from the exchanger by the outlet ports.

It is clear that as a result of this double change of direction, there is a significant variation in the temperature of the secondary fluid on leaving the tubes of the bundle in the discharge collector, the cylindrical layers located as close as possible to the inner ferrule permitting the discharge of a cooler secondary fluid then the tubes of the layers close to the outer ferrule, the heat exchange with the primary fluid having been less effective insaid latter inner layers. This variation is particularly due to a reduced supply of primary fluid to the tubes of the inner layers, particularly level with the inlet and outlet ports. As a result, there are significant differential expansions between the inner and outer ferrules, which leads to high mechanical stresses which are prejudicial to the good behaviour of the exchanger.

BRIEF SUMMARY OF THE INVENTION

The problem of the present invention is to obviate this disadvantage by ensuring a more homogeneous distribution of the hot primary fluid on entering the exchanger through the tubes of the bundle, more particularly between the layers of inner and outer tubes.

According to the invention, this problem is solved by an exchanger, wherein the bundle of tubes has means able to bring about a larger supply in the area occupied by the tubes of the inner layers than in the area occupied by the tubes of the outer layers, said means creating, in the circulation of primary fluid within the exchanger, a variable pressure drop.

According to a first embodiment, the means for realising this supply consist in the spacing members themselves, these members being hollow members or solid members, these members defining at least two zones provided with different pressure drops.

According to another embodiment, the tubes of the bundle are distributed in accordance with at least two zones with, in the inner layers, a radial and/or circumferential pitch which is smaller than in the outer layers.

BRIEF DESCRIPTION OF THE DRAWINGS

Other features of the intermediate exchanger for a fast neutron nuclear reactor according to the invention can be gathered from the following description of non-limitative embodiments and with reference to the attached drawings, wherein show.

DETAILED DESCRIPTION OF THE PREFERRED EMBODIMENTS

Figure 1:
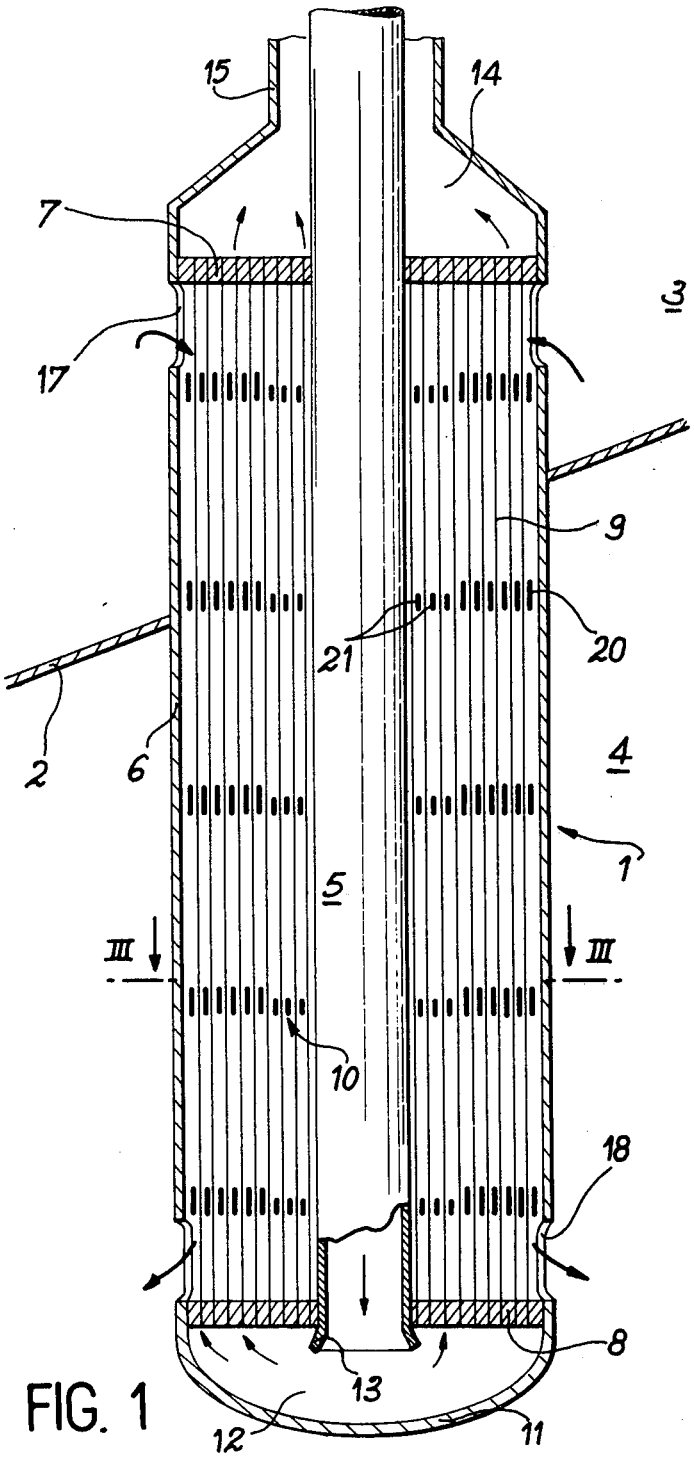
FIG. 1 is a diagrammatic view in axial section of an intermediate exchanger according to the invention in a first embodiment.

In the drawings, the same reference numerals are used to designate similar or identical members.

In FIG. 1, reference numeral 1 designated overall the intermediate exchanger according to the invention which is to be mounted within a not shown vessel of a fast neutron nuclear reactor, which has in particular a transverse member 2 traversed by the exchanger body. This member 2 defines within the said vessel two areas respectively 3 and 4, whereby area 3 receives the liquid cooling metal from the reactor core and has thus acquired calories on contact with the fuel assemblies, said sodium after traversing the intermediate exchanger 1 being collected beneath the member 2 in area 4 at a clearly lower temperature as a result of the heat exchange in the exchanger with a secondary fluid. Preferably, the primary and secondary fluids are liquid sodium.

Exchanger 1 essentially comprises an inner cylindrical ferrule 5, having a vertical axis and an outer cylindrical ferrule 6, which is coaxial to the ferrule 5, said two ferrules being joined respectively in the vicinity of their upper and lower ends by two plates 7 and 8 with horizontal tubes. Between plate 7 and 8 are located the tubes 9 of a bundle of straight tubes within which circulates the secondary fluid exchanging calories with the primary fluid, which itself flows in the exchanger externally of tubes 9. In the bundle, tubes 9 are appropriately spaced with respect to one another in order to form cylindrical layers, which are coaxial to the ferrule and in which the tubes are maintained at a predetermined spacing by means of transverse belts 10, whose details can be gathered more clearly from the partial view of FIG. 2. At its lower end, the exchanger has a base 11 which defines with the tubular plate 8 an admission collector 12 for the secondary fluid fed into the exchanger by means of the interior of inner ferrule 5, the latter having a lower open end 13. The secondary fluid admitted in this way to the inside of collector 12 flows in the tubes 9 of the bundle and it is finally collected in an upper collector 14 defined between the inner ferrule 5 and an extension 15 of the outer ferrule 6.

The hot primary fluid in area 3 penetrates the inside of the intermediate exchanger by inlet ports 17, which are regularly distributed about the exchanger axis in outer ferrule 6. This primary fluid flows from top to bottom in contact with tubes 9 over most of the length of the said tubes in countercurrent to the secondary fluid which passes from bottom to top within the same tubes. On leaving the exchanger, the primary fluid flows out of the outer ferrule 6 by outlet ports 18, which are also regularly distributed about the axis of the said ferrule.

Figure 2:
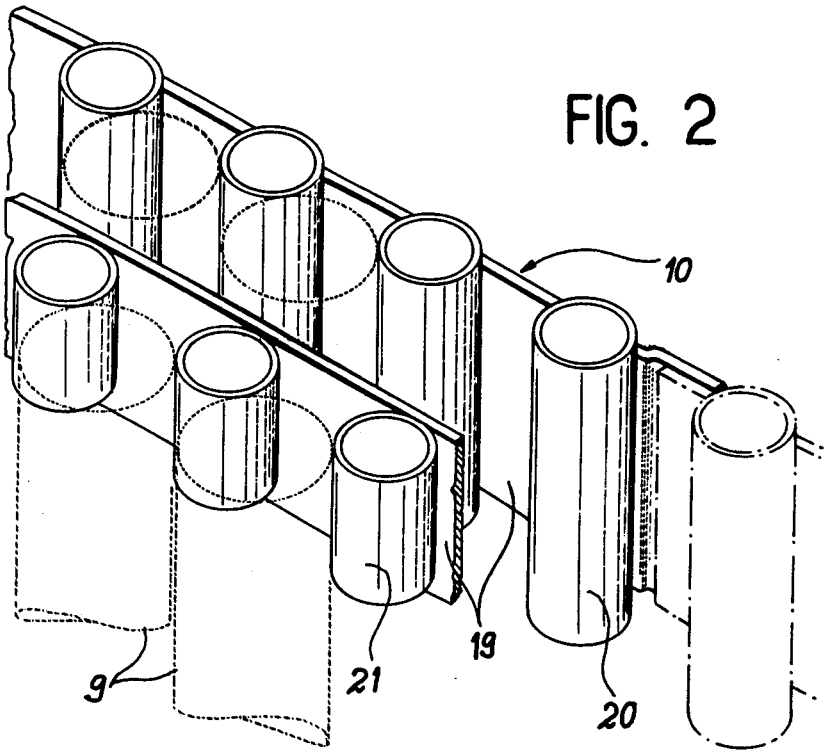
FIG. 2 a detailed perspective view of one of the reinforcing belts for the tubes of the exchanger of FIG. 1.

FIG. 2 illustrates in greater detail the practical construction of the spacing belts 10 which keep the tubes 9 of the bundle at a predetermined spacing from one another, whilst at the same time ensuring a protection thereof with respect to vibrations due to the circulation of the primary fluid. To this end, the belts 10 more particularly comprise horizontal bands 19 to which are welded spacing members such as 20 and 21.

Figure 3:
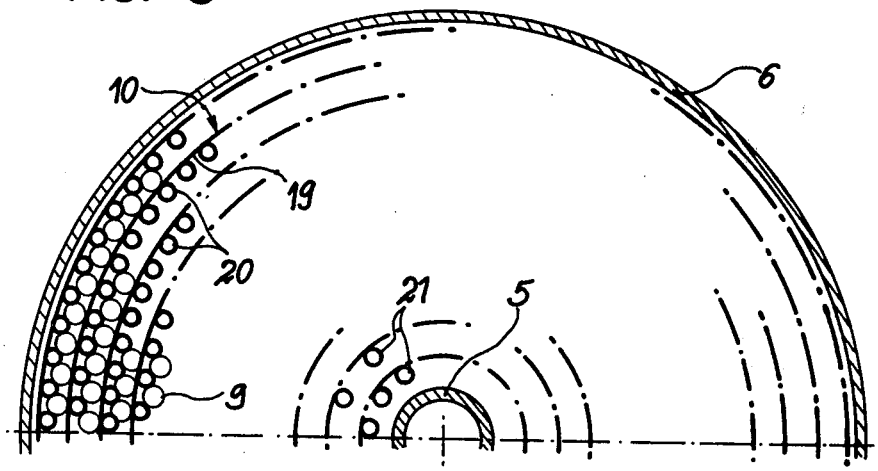
FIG. 3 is a sectional view of the exchanger of FIG. 1 along the line III—III of the latter.

According to the invention and specifically a first embodiment illustrated in FIGS. 1 to 3, the spacing members consist in the tube members 20 and 21 of the spacing belts 10 provided between ferrules 5 and 6 are such that they have different lengths and more particularly so that the longer hollow members 20 are disposed in the outer layers of the bundle, whilst the shorter members 21 are provided in the inner layers.

As a result of these arrangements, there is a primary fluid oversupply to the inner layers in the intermediate part of the exchanger and specifically in the area where this primary fluid, after transversely penetrating through the entry ports 17 and after having undergone a first 90° direction change flows parallel to the direction of the tubes in counter-current to the secondary fluid within the latter. This oversupply created in this way between the tubes 9 greatly increases the heat exchange for the tubes in question in their central area and brings about a better overall equilibrium in the heat exchange between the different areas of the tubes, more particularly by making it possible to restablish at the outlet therefrom in collector 14 a substantially uniform temperature.

Obviously, the above solution can be improved by having a larger number of areas with in eache of these hollow members of different lengths, varying gradually from the outer layers to the inner layers.

Figure 6:
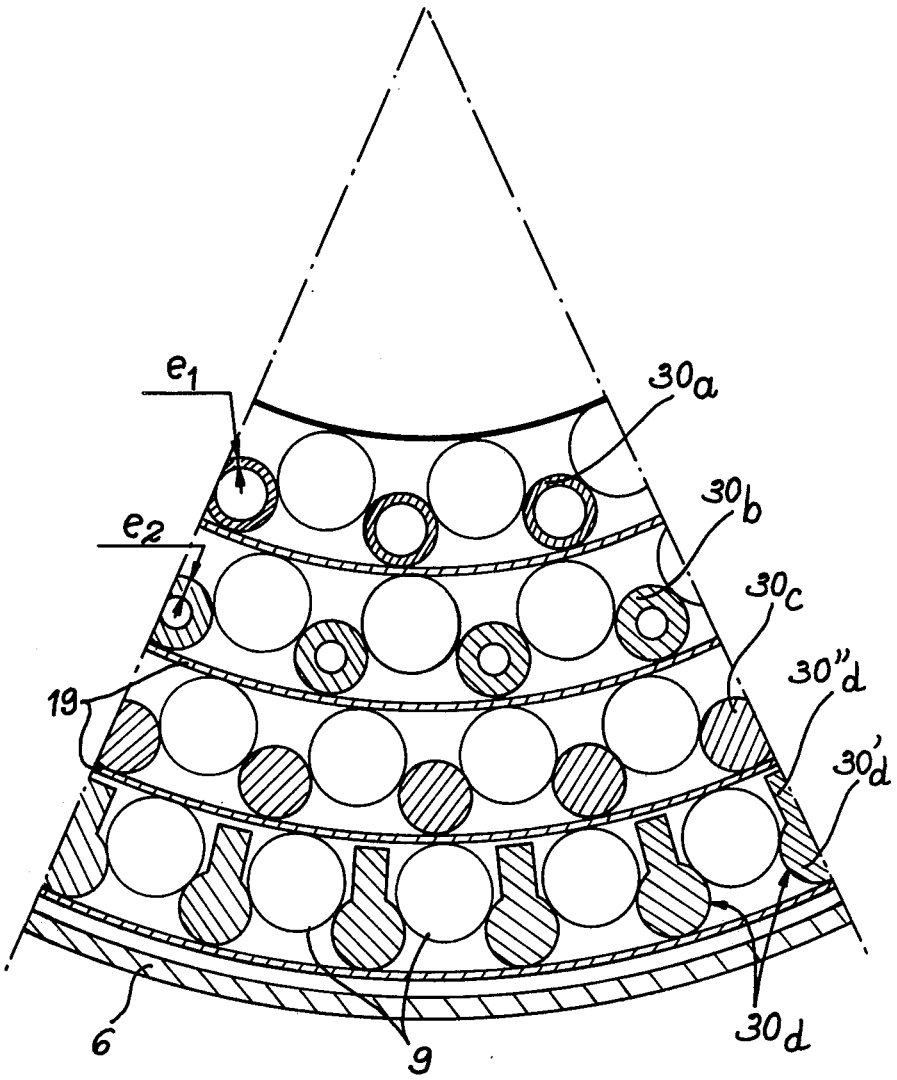
FIG. 6 is a partial sectional view of the heat exchanger showing a further embodiment of the invention.

According to the embodiment illustrated by FIG. 6 the various concentric zones are carried out by providing said spacing elements 30 with an horizontal cross-section (perpendicular with the axis of the heat exchanger) having a shape or an outline adapted to create a pressure drop which is reduced from the periphery to the central part of the heat exchanger. In the first zone the spacing members consist in tubular members 30*a* the thickness of which is equal to $e_1$. The second zone is provided with spacing members 30*b* consisting with tubular members. These tubular members have preferably the same external diameter as the tubular members 30*a* but their thickness is equal to $e_2$ ($e_2$ being higher than $e_1$). The third zone is provided with spacing members consisting into solid rods 30*c* the external diameter of which is preferably equal to the external diameter of the tubular members 30*a* or 30*b*. Finally, the spacing members 30*d* of the fourth zone consists in the combination of a solid rod 30′*d* together with a projecting member 30″*d* which is inserted between the heat exchanging tubes 9.

Consequently, it is clear for one skilled in the art that the pressure drop is increased from the central zone to the peripherical zone.

Obviously the spacing members 30*d* may have a different outline according to an horizontal cross-section. It clearly appears to one skilled in the art that the only purpose is to adapt the outline of the horizontal cross-section of the spacing members to the required pressure drop.

Moreover the several zones may be defined by spacing members only consisting in tubular members (30*a*, 30*b*...) the tubular members of the different zones being provided with different thickness.

Finally, it may be useful to combine variable outlines in cross-section and variable lengthes of the spacing members in order to obtain the required pressure drop corresponding to the plurality of zones.

Figure 4:
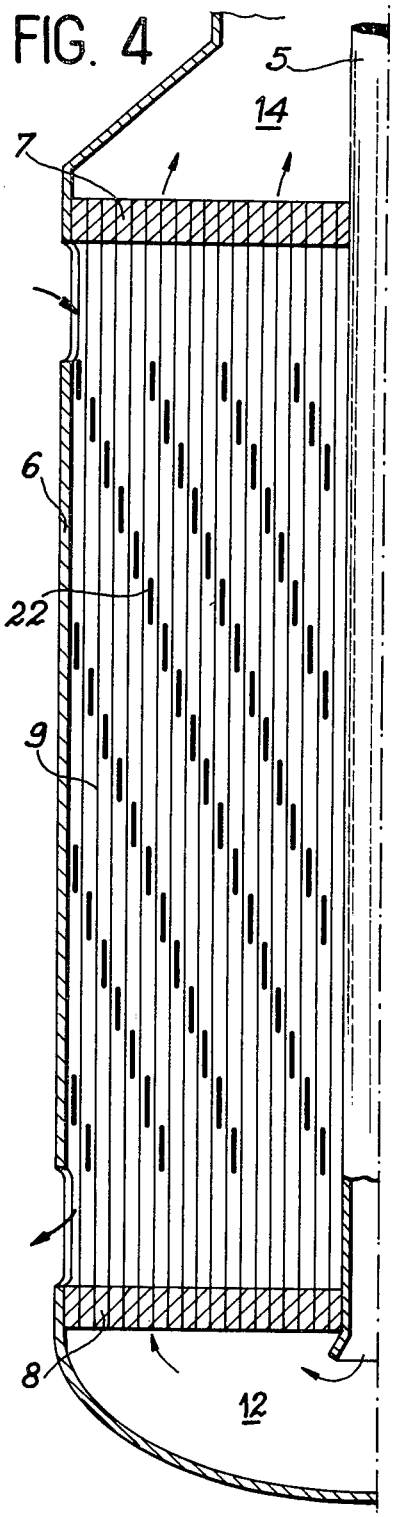
FIGS. 4 and 5 are respectively half-views in axial section illustrating two other variants.

According to the variant illustrated by FIG. 4, the oversupply of the areas occupied by the outer layers on the one hand and the inner layers on the other can be obtained by staggering the spacing belts 10 along the length of these tubes in such a way that the spacing members 22 forming the same and which are in contact with the said tubes create in the layers a funnel effect, with the formation of a horizontal component in the primary fluid flow in the direction of the centre of the apparatus, thereby significantly improving the supply of the inner layers. Preferably the spacing members consist of hollow or tubular members.

Each hollow member creates a local pressure drop and it is the progressive staggering of the hollow members in the axial direction which brings about the funnel effect and therefore the horizontal component of the fluid flow velocity.

Figure 5:
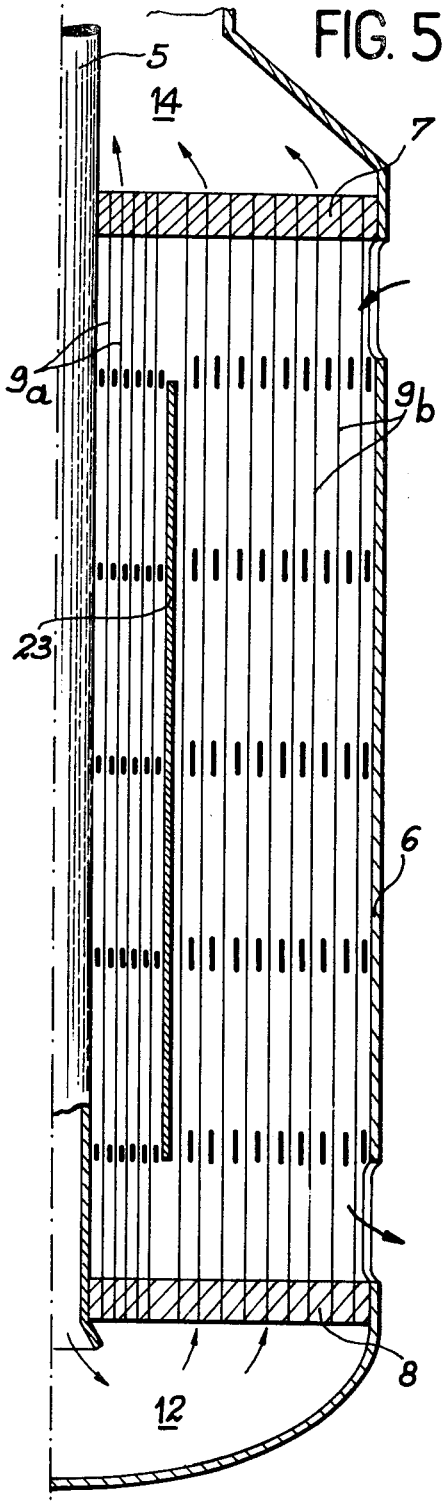

According to the embodiment illustrated in FIG. 5, the tubes of the bundle are arranged in two areas, respectively 9*a* and 9*b* where they are different radial and circumferential pitches, the tubes 9*a* in the vicinity of the inner ferrul 5 having a smaller pitch than the tubes 9*b* in the vicinity of the outer ferrule 6. Advantageously, these two areas are separated by an inner skirt 23 which is coaxial to ferrules 5 and 6. Thus, in this embodiment, the better fluid distribution is obtained by creating different pressure drops in the same horizontal plane.

In this embodiment, the penetration of the primary fluid into the area of the tubes close to the inner ferrule 5 is facilitated and in this way is a more effective heat exchange in this area.

It is to be noted that for the balancing of the pressure drops between two areas, it is also possible to place in the latter anti-vibratory belts which create, as in the embodiments of FIGS. 1 and 4, differential pressure drops in order to counter balance the smaller linear pressure drop due to the greater pitch of tubes 9*b*.

The invention is not limited to the embodiments described and represented hereinbefore and various modifications are possible thereto without passing beyond the scope of the invention.

What is claimed is:

1. An intermediate heat exchanger comprising a cylindrical internal ferrule having a vertical axis, an external ferrule coaxial to and surrounding the internal ferrule, two annular plates between said ferrules horizontally spaced and located in the vicinity of the upper and lower ends of said ferrules, a bundle of straight tubes located in the annulus between the internal and external ferrules and extending vertically between the annular plates in the form of cylindrical layers coaxial to the ferrules, said layers being mutually reinforced by transverse belts formed by horizontal bands carrying spacing members located between the tubes of the layers and in contact with the latter, said spacing members being disposed in a plurality of horizontal planes, collectors for the admission and discharge of the secondary fluid circulating within said tubes being respectively provided beneath the lower plate and above the upper plate, the inner ferrule forming a pipe for the supply of the secondary fluid to the admission collector, while the outer ferrule is upwardly extended by a pipe for the discharge of the same secondary fluid collected in the discharge collector after passing through the tubes, inlet and outlet ports distributed about the axis of the outer ferrule for the admission and discharge of a primary fluid in the vicinity of the annular plates which exchanges calories with the secondary fluid through the wall of the tubes, wherein the geometry of the spacing members is different according to their radial position in the same horizontal plane to create, in the circulation of primary fluid with the exchanger, a variable pressure drop such that the supply of primary fluid is larger in the area occupied by the tubes of the inner layers than in the area occupied by the tubes of the outer layers.

2. An exchanger according to claim 1, wherein the spacing members have different thicknesses.

3. An exchanger according to claim 1, wherein at least a plurality of the spacing members are solid cylindrical members with vertical generating lines, the cross-section of the spacing members of a same level having shapes which are suitable to bring about different pressure drops.

* * * * *